US008337244B2

(12) United States Patent
Sawamura

(10) Patent No.: US 8,337,244 B2
(45) Date of Patent: Dec. 25, 2012

(54) WATERPROOF CONNECTOR WITH RUBBER SHEET HAVING RESILIENT MEMBER

(75) Inventor: Naohito Sawamura, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 148 days.

(21) Appl. No.: 12/994,256

(22) PCT Filed: Dec. 1, 2008

(86) PCT No.: PCT/JP2008/071820

§ 371 (c)(1),
(2), (4) Date: Nov. 23, 2010

(87) PCT Pub. No.: WO2009/153894

PCT Pub. Date: Dec. 23, 2009

(65) Prior Publication Data

US 2011/0111627 A1 May 12, 2011

(30) Foreign Application Priority Data

Jun. 19, 2008 (JP) ..... 2008-160998

(51) Int. Cl.
*H01R 9/05* (2006.01)

(52) U.S. Cl. ..... 439/587; 439/271

(58) Field of Classification Search ..... 439/587, 439/271, 588, 275, 589
See application file for complete search history.

(56) References Cited

U.S. PATENT DOCUMENTS

| | | | | |
|---|---|---|---|---|
| 5,145,410 | A * | 9/1992 | Maejima et al. | 439/587 |
| 5,613,868 | A * | 3/1997 | Ohsumi et al. | 439/275 |
| 5,634,807 | A * | 6/1997 | Saito | 439/275 |
| 6,494,740 | B1 * | 12/2002 | Fukuda et al. | 439/587 |
| 6,739,908 | B2 * | 5/2004 | Hamai et al. | 439/587 |
| 7,371,115 | B1 * | 5/2008 | Hsieh et al. | 439/587 |
| 2002/0052142 | A1 | 5/2002 | Ishikawa et al. | |

FOREIGN PATENT DOCUMENTS

| | | |
|---|---|---|
| JP | 4-58975 | 5/1992 |
| JP | 7-320811 | 12/1995 |
| JP | 11-354195 | 12/1999 |
| JP | 2001-351724 | 12/2001 |
| JP | 2002-141137 | 5/2002 |
| JP | 2004-363068 | 12/2004 |

* cited by examiner

*Primary Examiner* — Hae Moon Hyeon
(74) *Attorney, Agent, or Firm* — Gerald E. Hespos; Michael J. Porco

(57) ABSTRACT

A housing (11) of a waterproof connector (10) is formed with terminal accommodating chambers (12) arranged in rows one above another and columns. A rubber sheet (20) for sealing is arranged at a terminal insertion surface side of the housing (11) and has wire insertion holes (24) corresponding to the terminal accommodating chamber (12). The wire insertion holes (24) are dimensioned to be held in close contact with the outer circumferential surfaces of wires (30) inserted therethrough. The rubber sheet (20) is with resilient members (22) having a larger modulus of elasticity than a rubber sheet main body (21) in parts at least on a wire insertion side surface (21*a*) either or both between the respective rows of the wire insertion holes of the rubber sheet main body (21) formed with the wire insertion holes (24) or/and between the respective columns of the wire insertion holes.

7 Claims, 6 Drawing Sheets

WATERPROOF CONNECTOR WITH RUBBER SHEET HAVING RESILIENT MEMBER

BACKGROUND OF THE INVENTION

1. Field of the Invention

The present invention relates to a waterproof connector and particularly to a waterproof connector including a sealing member at a terminal insertion surface of the connector for preventing water penetration into terminal accommodating chambers of the connector.

2. Description of the Related Art

A waterproof structure using a one-piece waterproof rubber plug formed with wire insertion holes, though which a plurality of wires are insertable, is known as a waterproof means between the wires and a housing in a waterproof connector (see, for example, JP2001-351724).

As shown in FIG. 11, in a waterproof connector 1 of this type, a one-piece waterproof rubber plug 4 formed with a plurality of wire insertion holes 5 is so mounted that an outer circumferential sealing portion 6 thereof is held in close contact with the inner circumferential surface of a rubber plug accommodating tube portion 3 provided on a rear surface of a housing 2. Since this prevents water from penetrating to inserted portions of wires W without mounting a separate waterproof rubber plug on each of the plurality of wires W, there are advantages that intervals between the wires W can be narrowed and the structure of the rubber plug accommodating tube portion 3 on the housing 2 can be simplified.

However, the one-piece waterproof rubber plug 4 as described above has the following problem. When the wires W are inserted through the wire insertion holes 5 as shown in FIG. 12, the wire insertion hole 5*b* having the wire not yet inserted therethrough is pressed in such directions as to become narrower by being affected by resilient deformations of the wire insertion holes 5*a* having the wires already inserted therethrough and a resilient force of the entire rubber plug 4 decreases at a final stage, wherefore it becomes more difficult to insert the wire. Further, if the resilient force of the rubber plug 4 decreases, a degree of adhesion between the rubber plug accommodating tube portion 3 on the housing 2 shown in FIG. 11 and the rubber plug 4 also decreases, thereby causing a problem of deteriorating a waterproof performance.

SUMMARY OF THE INVENTION

The present invention was developed in view of the above problems and an object thereof is to prevent diameter reducing deformations of wire insertion holes having wires not yet inserted therethrough and a reduction in a resilient force of an entire sealing member as wires are inserted through the wire insertion holes formed in the sealing member.

In order to solve the above problem, the present invention is directed to a waterproof connector, comprising: a connector housing formed with a plurality of terminal accommodating chambers arranged in a plurality of rows one above another and a plurality of columns, and a rubber sheet for sealing arranged on a terminal insertion surface side of the connector housing and formed with a plurality of wire insertion holes corresponding to the terminal accommodating chambers, the wire insertion holes being so dimensioned as to be held in close contact with the outer circumferential surfaces of wires to be inserted therethrough, wherein the rubber sheet includes a rubber sheet main body formed with the wire insertion holes at positions corresponding to the respective terminal accommodating chambers in the plurality of rows and the plurality columns and fitted with a resilient member having a larger modulus of elasticity than the rubber sheet main body in a part at least on a wire insertion side surface either or both between the adjacent rows of the wire insertion holes of the rubber sheet main body or/and between the adjacent columns of the wire insertion holes.

According to the above construction, since the resilient member having a larger modulus of elasticity is fitted between the respective rows or/and between the respective columns of the wire insertion holes, resilient deformations of peripheral edge portions of the wire insertion holes having the wires inserted therethrough can be absorbed by the resilient member with the wires already inserted through the wire insertion holes, wherefore a reduction in the modulus of elasticity of the entire rubber sheet can be prevented.

Thus, deformations of peripheral edge portions of the remaining wire insertion holes to become narrower are alleviated by a resilient deformation of the resilient member and the peripheral edge portions are ensured to have appropriate elasticity of a predetermined level or higher. Therefore, the wires can be smoothly inserted up to the last one. Further, since the reduction in the modulus of elasticity of the rubber sheet can be prevented in this way, a degree of adhesion between the inner circumferential surface of the frame-shaped opening of the connector housing and the outer circumferential surface of the rubber sheet can be increased, whereby a waterproof property of a sealing portion can be improved.

In an operation of inserting the wire through the wire insertion hole, it is most difficult to first insert a terminal connected to the wire through the wire insertion hole. However, the modulus of elasticity of the peripheral edge portion of the wire insertion hole particularly at a wire insertion side can be increased by fitting the resilient member into the part at least on the wire insertion side surface of the rubber sheet main body. Therefore, the operation of inserting a leading end portion of the wire through the wire insertion hole can be facilitated and operability can be effectively improved.

The resilient member of the rubber sheet may be fitted through the rubber sheet main body or fitted in a part on each of the wire insertion side surface and an opposite surface.

The resilient member is in the form of a sheet extending in either or both a horizontal direction or/and a vertical direction with respect to the rubber sheet or in the form of cylinders or rectangular columns spaced apart in either or both the horizontal direction or/and the vertical direction and arranged in an offset manner at positions between the adjacent wire insertion holes of the rubber sheet.

When the wire insertion holes are arranged in three or more rows one above another in the rubber sheet, it is preferable that the wire insertion holes in the upper and lower rows are larger than those in the middle row and the sheet-like resilient members are arranged to extend in the horizontal direction between the upper and middle rows and between the middle and lower rows or the cylindrical or rectangular column-shaped resilient members are arranged in an offset manner with respect to the wire insertion holes.

By making the wire insertion holes in one or more middle rows smaller than those in the upper and lower rows and using them for small-diameter wires, the influence of a reduction in modulus of elasticity on the peripheral edge portions of the wire insertion holes in the middle row(s) can be suppressed and the wires can be smoothly inserted through the wire insertion holes in the middle row(s) even in a state where the wires are already inserted through the wire insertion holes in the upper and lower rows.

The rubber sheet is preferably formed in two colors using rubbers having different colors for the main body and the resilient member.

If the resilient member is fitted beforehand at the time of molding the rubber sheet, it is not necessary to fit the resilient member at a later stage and there is no likelihood that the resilient member is detached from the rubber sheet main body.

As described above, according to the present invention, the resilient deformations of the peripheral edge portions of the wire insertion holes resulting from the insertion of the wires through these wire insertion holes can be absorbed by the resilient member by fitting the resilient member having a larger modulus of elasticity either or both between the respective rows of the wire insertion holes of the rubber sheet or/and between the respective columns of the wire insertion holes. Since this can prevent deformations of the remaining wire insertion holes to become narrower and the reduction in modulus of elasticity, the wires can be smoothly inserted up to the last one.

By preventing the reduction in the modulus of elasticity of the rubber sheet, the degree of adhesion between the inner circumferential surface of the frame-shaped opening of the connector housing and the outer circumferential surface of the rubber sheet can be increased, wherefore a sealing effect by the rubber sheet can be reliably displayed.

DETAILED DESCRIPTION OF THE PREFERRED EMBODIMENTS

Hereinafter, embodiments of the present invention are described with reference to the drawings.

Figure 1:
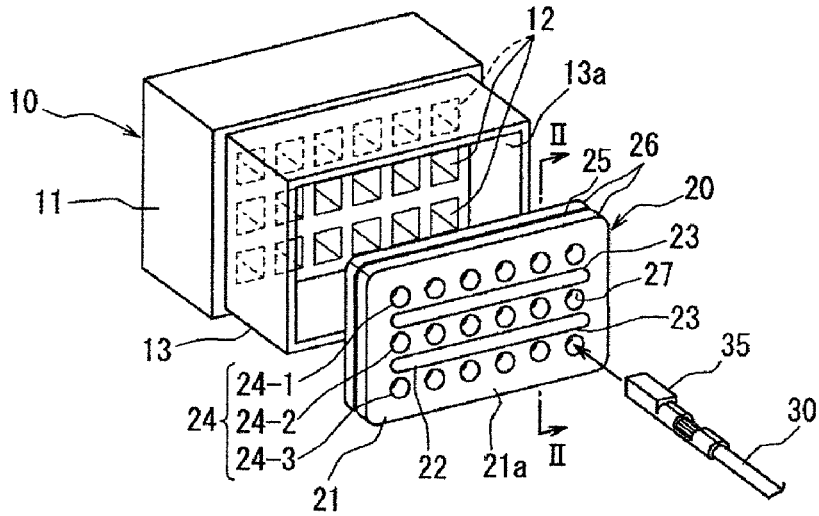
FIG. 1 is an exploded perspective view of a waterproof connector according to a first embodiment of the invention.
Figure 2:
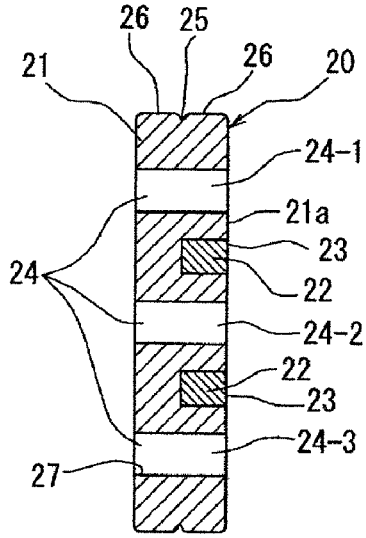
FIG. 2 is a section along II-II of a rubber sheet shown in FIG. 1.
Figure 3:
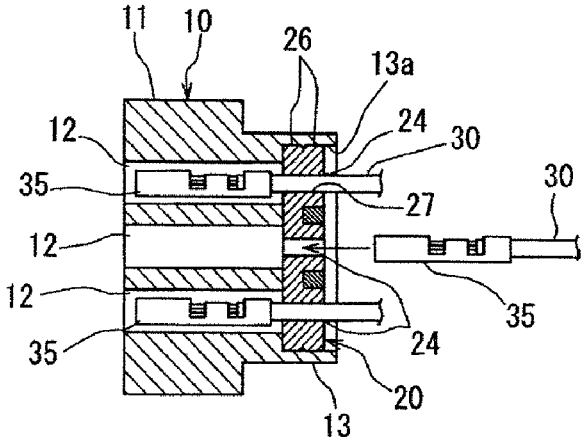
FIG. 3 is a section showing a process of inserting terminals at ends of wires into terminal accommodating chambers with the rubber sheet mounted in a connector housing.

FIGS. 1 to 3 show a waterproof connector 10 according to a first embodiment of the present invention.

As shown in FIG. 1, the waterproof connector 10 is provided with a housing 11 made of synthetic resin, terminal accommodating chambers 12 formed in this housing, and a rubber sheet 20 for sealing clearances between the outer circumferential surfaces of wires 30 connected to terminals 35 inserted into these terminal accommodating chambers 12 and the housing 11.

The waterproof connector 10 includes a connecting portion to be connected with a mating connector (not shown) before the housing 10, and the housing 11 includes a rubber sheet accommodating frame portion 13 in the form of a long rectangular frame in a rear part thereof, wherein the interior of the frame portion 13 serves as a mounting area for the rubber sheet 20.

The terminal accommodating chambers 12 penetrate the housing 11 in forward and backward directions and are arranged in three rows one above another and six columns.

The rubber sheet 20 is comprised of a rubber sheet main body 21 formed with wire insertion holes 24 penetrating in forward and backward directions at positions corresponding to an arrangement of the respective terminal accommodating chambers 12, and resilient member fitted portions 23 fitted with resilient members 22 having a larger modulus of elasticity than the rubber sheet main body 21. The rubber sheet 20 is integrally formed using rubbers having different colors for the rubber sheet main body 21 and for the resilient members 22 at the time of molding.

The rubber sheet main body 21 has such an outer shape as to be closely fittable to the inner circumferential surface of the rubber sheet accommodating frame portion 13 of the housing 11. An annular groove 25 is formed in an outer peripheral portion of the rubber sheet main body 21, sides at the opposite front and rear sides of the annular groove 25 are raised outwardly, and the raised portions serve as outer circumferential sealing portions 26 to be resiliently held in close contact with an inner circumferential surface 13*a* of the rubber sheet accommodating frame portion 13.

The inner circumferential surfaces of the wire insertion holes 24 of the rubber sheet main body 21 are set at such a diameter that they can be resiliently held in close contact with the outer circumferential surfaces of the wires 30, and serve as inner circumferential sealing portions 27.

The resilient member fitted portions 23 are formed to extend in a horizontal direction between the wire insertion holes 24-1 in the upper row of the rubber sheet main body 21 and the wire insertion holes 24-2 in the middle row and between the wire insertion holes 24-2 in the middle row and the wire insertion holes 24-3 in the lower row. The resilient member fitted portion 23 is arranged between any pair of vertically adjacent wire insertion holes 24.

As shown in FIG. 2, the resilient member fitted portions 23 are formed in parts on a wire insertion side surface 20*a* of the rubber sheet main body 21, and the depth thereof is substantially half the thickness (in forward and backward directions) of the rubber sheet main body 21. The resilient members 22 in the resilient member fitted portions 23 are in the form of sheets extending in the horizontal direction.

To assemble the waterproof connector 10 having the above construction, the rubber sheet 20 is first inserted into the rubber sheet accommodating frame portion 13 of the housing 11. In an inserted state, the rubber sheet 20 is inserted and positioned to such a depth as to be held in contact with the rear end surface of the terminal accommodating chambers 12 and the outer circumferential sealing portions 26 are resiliently held in close contact with the inner circumferential surface 13*a* of the rubber sheet accommodating frame portion 13 as shown in FIG. 3, thereby making the rear side of the housing 11 watertight.

Subsequently, the terminals 35 mounted on the leading ends of the wires 30 are inserted through the respective wire insertion holes 24 of the rubber sheet 20 mounted in the rubber sheet accommodating frame portion 13 and held and retained by locking lances (not shown) at predetermined positions in the terminal accommodating chambers 12. At this time, the outer circumferential surfaces of the wires 30 connected to the terminals 35 inserted into the terminal accommodating chambers 12 are resiliently held in close contact with the inner circumferential sealing portions 27 of the wire insertion holes 24, whereby it is held watertight between the outer circumferential surfaces of the wires 30 and the wire insertion holes 24.

Figure 4:
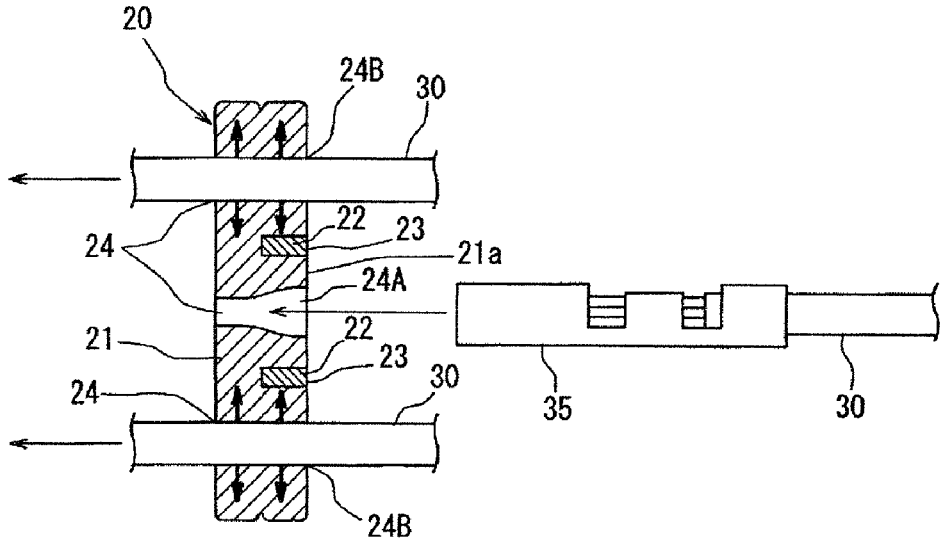
FIG. 4 is a section showing a resiliently deformed state of the rubber sheet resulting from insertion of the wires.

As the wires 30 are inserted one by one through the respective wire insertion holes 24 in this way, the wire insertion holes 24B having the wires 30 already inserted therethrough are resiliently deformed in such directions as to become larger as shown in FIG. 4. These resilient deformations are absorbed by resilient deformations of the resilient members 22 in the resilient member fitted portions 23, thereby alleviating an influence on the wire insertion holes 24A having the wires not yet inserted therethrough.

During an inserting operation of the wire 30 through the wire insertion hole 24, it is most difficult to first insert the terminal 35 connected to the wire 30 through the wire insertion hole 24. However, since the resilient member fitted portions 23 are arranged in the parts on the wire insertion side surface 21*a* of the rubber sheet main body 21, the wire insertion holes 24A having the wires not yet inserted can be prevented from being deformed in such directions as to become narrower particularly at a wire insertion side and a reduction in modulus of elasticity at this wire insertion side can also be prevented.

Accordingly, the terminal 35 connected to the end of the wire 30 can be easily inserted through the wire insertion hole 24A and the wires can be smoothly inserted up to the last one.

Since the reduction in the modulus of elasticity of the entire rubber sheet 20 can be prevented by providing the resilient member fitted portions 23, a reduction in adhesion between the outer circumferential sealing portions 26 of the rubber sheet 20 and the inner circumferential surface 13*a* of the rubber sheet accommodating frame portion 13 can also be prevented, wherefore a stable sealing property can be displayed.

Figure 5:
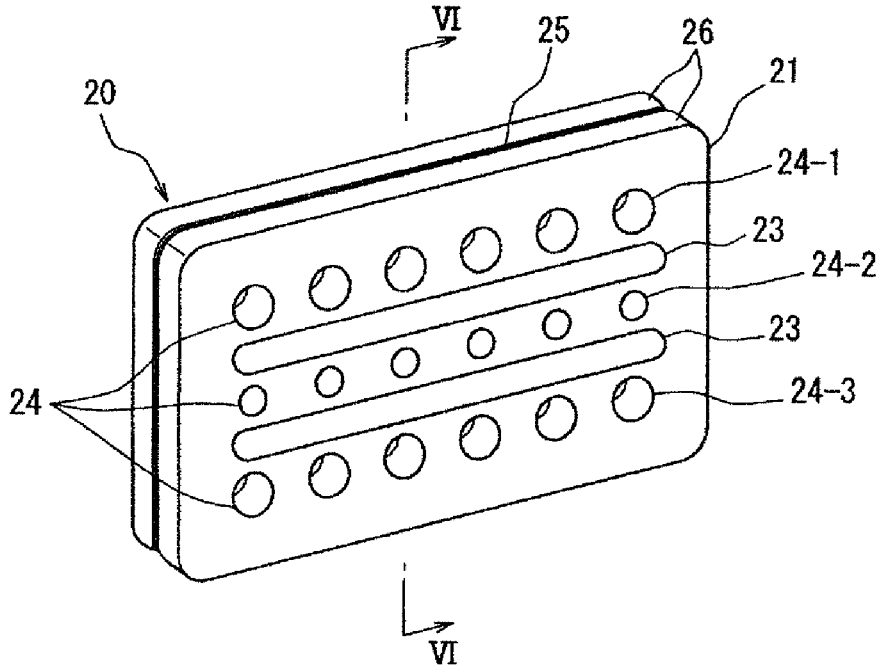
FIG. 5 is a perspective view of a rubber sheet of a waterproof connector according to a second embodiment of the invention.
Figure 6:
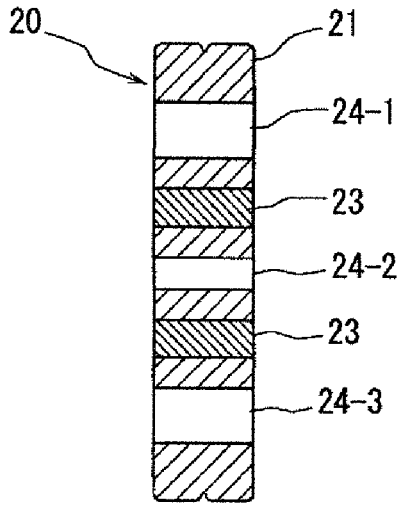
FIG. 6 is a section along VI-VI of FIG. 5.

FIGS. 5 and 6 show a second embodiment of the present invention.

In the second embodiment, wire insertion holes 24 are formed in three rows one above another and six columns in a rubber sheet main body 21. Out of these wire insertion holes 24, six wire insertion holes 24-2 in the middle row have a smaller diameter than that of the wire insertion holes 24-1 in the upper row and the wire insertion holes 24-3 in the lower row and serve as through holes for small-diameter wires. Further, resilient member fitted portions 23 penetrate the rubber sheet main body 21 in forward and backward directions. The other construction is the same as in the first embodiment.

In this embodiment, as wires 30 are first inserted through the wire insertion holes 24-1, 24-3 in the upper and lower rows, the wire insertion holes 24-1, 24-3 in these upper and lower rows are resiliently deformed in such directions as to become larger. These resilient deformations could affect the wire insertion holes 24-2 in the middle row, but the wire insertion holes 24-2 in the middle row have a lower deformation ratio since having a small diameter, wherefore the influence can be suppressed to a low level.

Further, the resilient deformations of the wire insertion holes 24-1, 24-3 in the upper and lower rows are effectively absorbed by the resilient member fitted portions 23 penetrating the rubber sheet main body 21.

Thus, the wire insertion holes 24-2 in the middle row having the wires not yet inserted therethrough are hardly deformed in such directions as to become narrower and a reduction in the modulus of elasticity of peripheral edge portions can be prevented, wherefore the wires can be smoothly inserted up to the last one.

Figure 7:
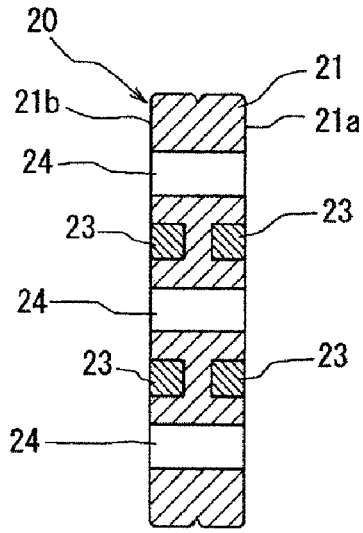
FIG. 7 is a section showing a third embodiment.

FIG. 7 shows a third embodiment. In the third embodiment, resilient member fitted portions 23 are not formed to penetrate a rubber sheet main body 21, but provided in parts on a wire insertion side surface 21*a* of the rubber sheet main body 21 and on an opposite surface 21*b*.

The other construction is similar to the first embodiment and has the same functions and effects.

Figure 8:
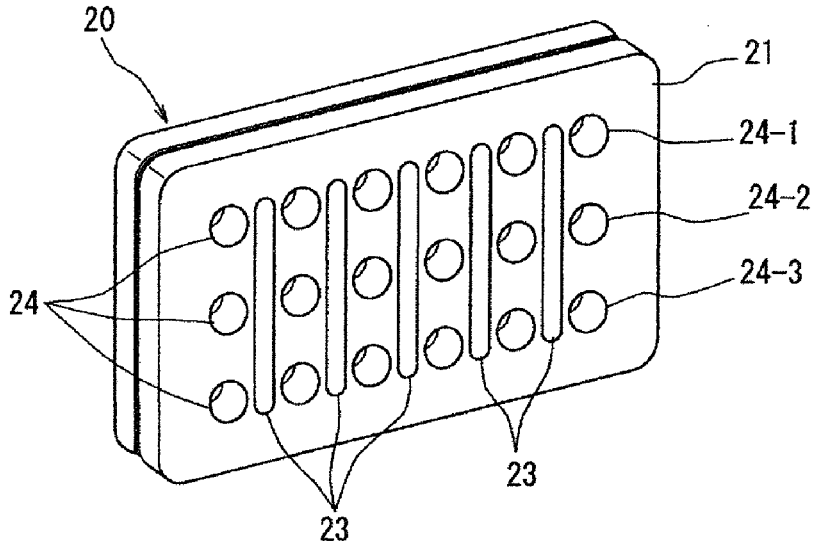
FIG. 8 is a perspective view of a rubber sheet according to a fourth embodiment.

FIG. 8 shows a fourth embodiment. In the fourth embodiment, resilient member fitted portions 23 extend in a vertical direction between adjacent columns of wire insertion holes 24 of a rubber sheet main body 21.

The other construction is similar to the first embodiment and has the same functions and effects.

Figure 9:
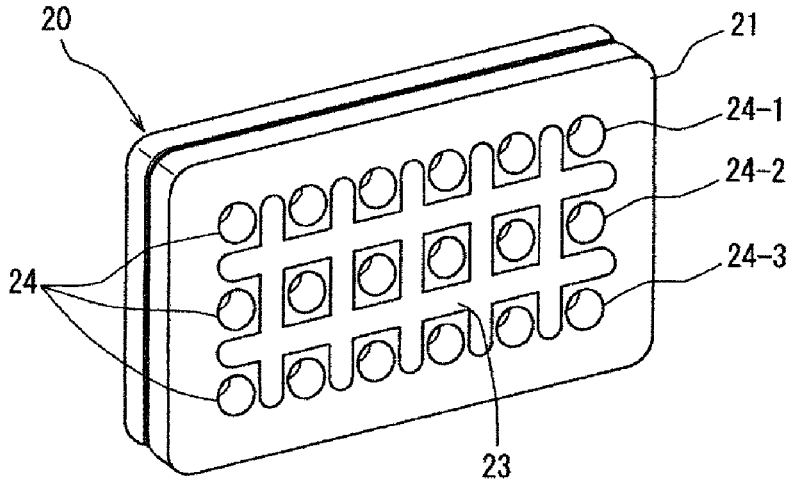
FIG. 9 is a perspective view of a rubber sheet according to a fifth embodiment.

FIG. 9 shows a fifth embodiment. In the fifth embodiment, a resilient member fitted portion 23 extends in a horizontal direction between adjacent rows of wire insertion holes 24 and also extends in a vertical direction between adjacent columns of wire insertion holes 24, thereby having a lattice shape.

The other construction is similar to the first embodiment and has the same functions and effects.

Figure 10:
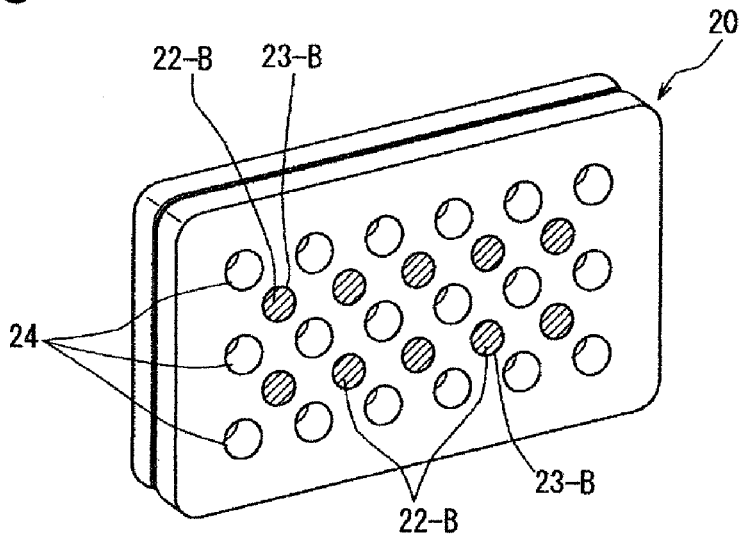
FIG. 10 is a perspective view of a rubber sheet according to a sixth embodiment.
Figure 11:
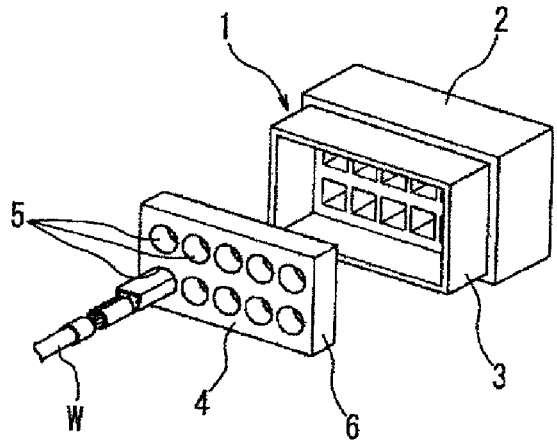
FIG. 11 PRIOR ART
FIG. 11 is a view showing a prior art.
Figure 12:
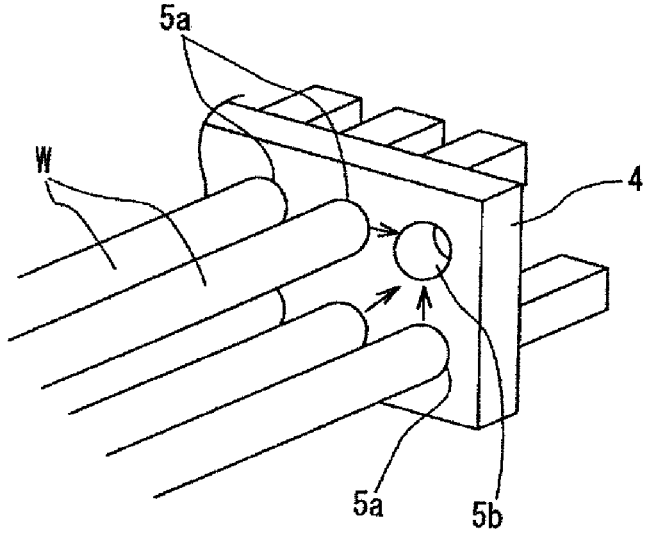
FIG. 12 PRIOR ART
FIG. 12 is a diagram showing a problem of the prior art.

FIG. 10 shows a sixth embodiment. Although the resilient member fitted portions 23 extend in the horizontal direction and/or the vertical direction in the rubber sheet main body 21 and the fitted resilient members 22 are sheet-like in the first to fifth embodiments, resilient member fitted portions 23-B of the sixth embodiment have a circular shape and fitted resilient members 22-B respectively have a cylindrical shape and are arranged in a scattered manner.

The rubber sheet main body 21 is formed with wire insertion holes 24 arranged in three rows one above another and having the same diameter similar to the first embodiment. The resilient member fitted portions 23-B respectively fitted with the resilient members 22-B are arranged in an offset manner with respect to upper and lower wire insertion holes 24 between the wire insertion holes 24 in the upper and middle rows and between the wire insertion holes 24 in the middle and lower rows. In other words, the resilient member fitted portions 23-B are arranged at positions where no wire insertion holes 24 are present above and below. The diameter of these resilient member fitted portions 23-B is set to be smaller than that of the wire insertion holes 24.

The resilient member fitted portions 23-B are formed in the rubber sheet main body 21 as circular holes which are open in a wire insertion side surface, and the resilient members 22-B are press-fitted into the respective resilient member fitted portions 23-B in the form of circular holes. Note that the resilient members may have a rectangular column shape instead of the cylindrical shape. Further, the resilient members and the rubber sheet may be formed in two colors as in the first embodiment.

The other construction is similar to the first embodiment and has the same functions and effects.

What is claimed is:

1. A waterproof connector, comprising:

a connector housing with opposite front and rear ends and formed with a plurality of terminal accommodating chambers extending from the front end to the rear end, the terminal accommodating chambers being arranged in a plurality of rows one above another and a plurality of columns, each of the terminal accommodating chambers being configured for receiving a terminal fitting from the rear end of the connector housing so that the rear end of the connector housing defines a terminal insertion surface side of the connector housing; and a rubber sheet for sealing arranged on the terminal insertion surface side of the connector housing and formed with a plurality of wire insertion holes corresponding to the terminal accommodating chambers, the wire insertion holes being so dimensioned as to be held in close contact with the outer circumferential surfaces of wires to be inserted therethrough, wherein the rubber sheet includes a rubber sheet main body having a front surface arranged on the terminal insertion surface side of the connector housing and a rear surface opposite the front surface, the rubber sheet main body being formed with the wire insertion holes at positions corresponding to the respective terminal accommodating chambers in the plurality of rows and the plurality columns and the rear surface of the rubber sheet main body being fitted with at least one resilient member having a larger modulus of elasticity than the rubber sheet main body in at least one part between the adjacent rows of the wire insertion holes of the rubber sheet main body or/and between the adjacent columns of the wire insertion holes.

2. A waterproof connector, comprising:

a connector housing formed with a plurality of terminal accommodating chambers arranged in a plurality of rows one above another and a plurality of columns, and a rubber sheet for sealing arranged on a terminal insertion surface side of the connector housing and formed with a plurality of wire insertion holes corresponding to the terminal accommodating chambers, the wire insertion holes being so dimensioned as to be held in close contact with the outer circumferential surfaces of wires to be inserted therethrough, wherein the rubber sheet includes a rubber sheet main body formed with the wire insertion holes at positions corresponding to the respective terminal accommodating chambers in the plurality of rows and the plurality columns and fitted with a resilient member having a larger modulus of elasticity than the rubber sheet main body in a part at least on a wire insertion side surface either or both between the adjacent rows of the wire insertion holes of the rubber sheet main body or/and between the adjacent columns of the wire insertion holes and the resilient member of the rubber sheet is fitted through the rubber sheet main body or fitted in a part on each of the wire insertion side surface and an opposite surface.

3. The waterproof connector according to claim 1, wherein the resilient member is in the form of a sheet extending in at least one of a horizontal direction and a vertical direction with respect to the rubber sheet.

4. The waterproof connector according to claim 3, wherein, when the wire insertion holes are arranged in three or more rows one above another in the rubber sheet, the wire insertion holes in upper and lower rows being larger than those in a middle row and the resilient members being arranged between the upper and middle rows and between the middle and upper rows.

5. The waterproof connector according to claim 1, wherein the rubber sheet is formed in two colors using rubbers having different colors for the main body and the resilient member.

6. The waterproof connector according to claim 1, wherein the resilient member comprises resilient cylinders or rectangular columns spaced apart in at least one of a horizontal direction and a vertical direction.

7. The waterproof connector according to claim 6, wherein the cylinders or rectangular columns are arranged in an offset manner at positions between adjacent wire insertion holes of the rubber sheet.

* * * * *